US005318058A

United States Patent [19]

Zimmerman

[11] Patent Number: 5,318,058

[45] Date of Patent: Jun. 7, 1994

[54] SWING-FREE CRUTCH

[76] Inventor: Dennis V. Zimmerman, 909 North Villard, Tacoma, Pierce County, Wash. 98406

[21] Appl. No.: 79,034

[22] Filed: Jun. 21, 1993

[51] Int. Cl.[5] ..... A61H 3/02

[52] U.S. Cl. ..... 135/68; 135/71

[58] Field of Search ..... 135/68, 69, 71, 73, 135/75, 77, 78, 79, 84; 248/188.8; 292/339, 338

[56] References Cited

U.S. PATENT DOCUMENTS 3,738,674 6/1973 Pauls ..... 135/71 X

FOREIGN PATENT DOCUMENTS 3004028 8/1981 Fed. Rep. of Germany ..... 135/84

*Primary Examiner*—Carl D. Friedman
*Assistant Examiner*—Creighton Smith
*Attorney, Agent, or Firm*—James F. Leggett

[57] ABSTRACT

A novel improvement in a crutch device allowing for the rotational movement of the arms and elbows of the user while supporting his/her weight on a pair of these crutches, by displacing the vertical support means, between the under-arm rest and the hand rest, rearward a sufficient distance. This improvement, combined with an all terrain crutch pad and easy adjustable crutch length allows an individual with severe restriction in mobility from the waist down to play active sports, such as golf, and engage in employment requiring the free movement of hands and arms while maintaining mobility of the total person.

1 Claim, 2 Drawing Sheets

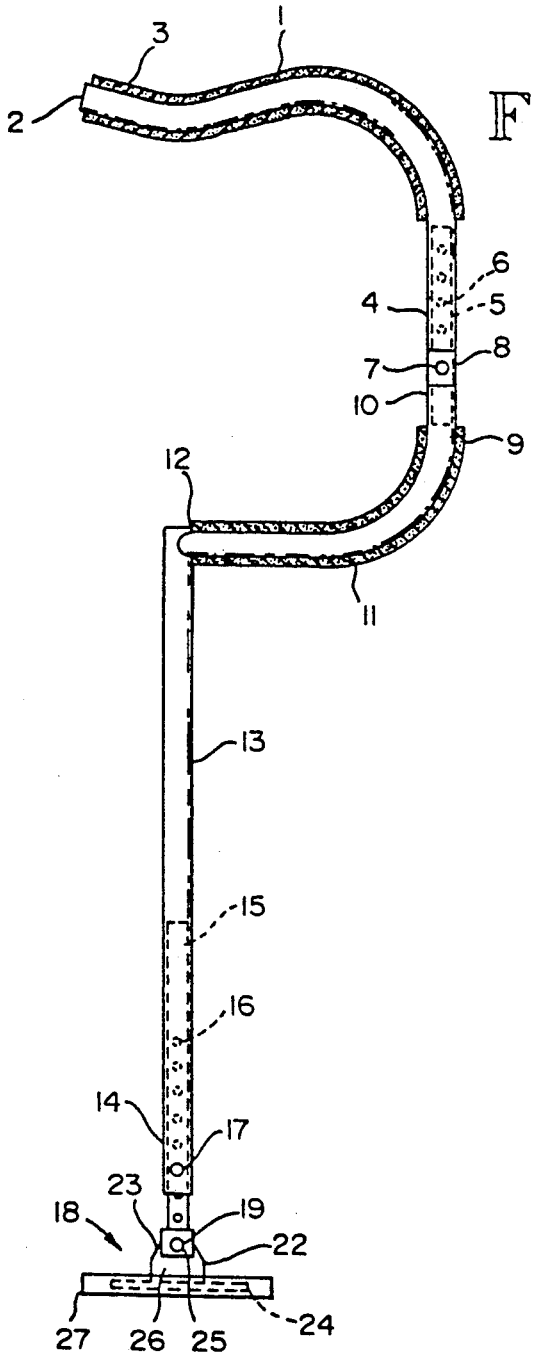
FIG. 1
FIG. 2
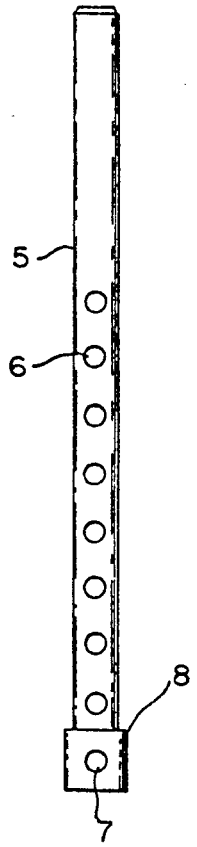
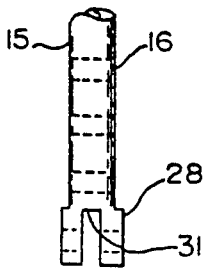
FIG. 3

FIG. 4
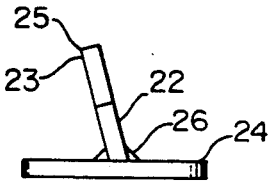
FIG. 5
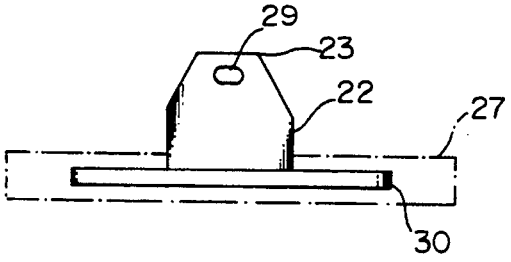
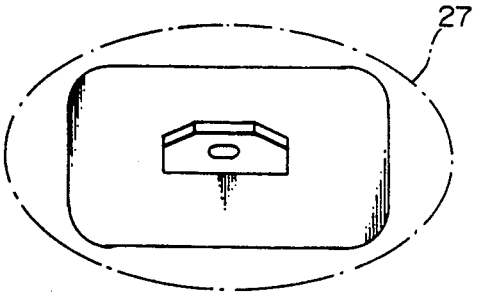
FIG. 6
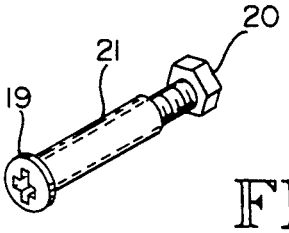
FIG. 7

SWING-FREE CRUTCH

BACKGROUND OF THE INVENTION

This invention relates generally to an improved vertical support means for individuals who have reduced control over their lower extremities, such as paraparetics, so that they may engage in physical activities which require free movement of their upper extremities, such as golf, while maintaining their mobility on uneven and unprepared terrain. More particularly, this invention involves displacing the vertical support between the underarm and the hand rest rearward a sufficient distance to allow the elbows of the user to swing in full travel while the weight of the user is suspended by the underarm portion.

In the past, light weight crutches, such as the Tubular Crutch disclosed in C. E. Murcott's U.S. Pat. No. 3,133,551, combined with expanded foot pads, such as those disclosed in K. A. Wilkinson's U.S. Pat. No. 4,899,771, have allowed more mobility on unprepared surfaces to individuals with limited use of their lower extremities. However, there has not been a device to allow such individuals to engage in active pursuits which require free rotation of the arms while in an upright position.

Therefore, the primary object of this invention is to provide people who have limited use of their lower extremities the opportunity to engage in physical activities, such as golf, which require free rotation of the arms while the torso remains upright. This invention will allow said individuals to engage in other work and recreational activities wherein upright mobility is required combined with the need to be able to freely swing their arms from the shoulder.

SUMMARY OF THE INVENTION

The foregoing objectives are satisfied by this invention, which is comprised of a device having a reversely bent underarm portion running from in front of the underarm, in a semi-circular manner, so that it rises above the underarm at the rear and then extends rearward a sufficient distance, preferably 9 inches from front end to vertical, to accommodate the free swing of the elbows, and then makes a reverse bend to vertical. This vertical run of the invention is provided with an adjustment means to vary the height of the free swing area between the shoulder rest and the hand rest. The hand rest portion communicates with the adjustment means in a reverse bend from the vertical, to parallel the run of the underarm portion, extends a like distance and is provided with a semi-circular portion near its end to accommodate the user's hand. The underarm and the hand rest portions are comprised of suitable light weight material, such as tubular aluminum, and are covered with padding, such as foam rubber. The hand rest portion communicates fixedly with the vertical support which extends downward a sufficient distance, so that when the user is resting on the underarm portion the lower extremities are fully extended. This vertical support is also provided with a height adjustment means at its base, similar to that on the vertical section between the underarm and the hand rest, and is rotationally attached to an all terrain foot of suitable design.

The novel features of the invention will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

BRIEF DESCRIPTION OF THE DRAWINGS

FIG. 1 is a side view of a crutch made according to my invention.

FIG. 2 is a side elevational view of the swing height adjustment means apart from the crutch.

FIG. 3 is a side elevational view of the height adjustment rod and its flange attachment fork apart from the crutch.

FIG. 4 is a front elevational view of the foot vertical support and inner foot apart from the crutch.

FIG. 5 is a side elevational view of the foot vertical support, inner foot and shoe print apart from the crutch.

FIG. 6 is a top elevational view of the inner foot and shoe print apart from the crutch.

FIG. 7 is an expanded view of the bolt or channel pin used to join the foot vertical support attachment flange to the height adjustment rod flange attachment fork.

DESCRIPTION OF THE PREFERRED EMBODIMENTS

With reference to the drawings and particularly FIG. 1 thereof, the preferred embodiment of the Swing-Free crutch is shown.

The Swing-Free Crutch is comprised of a shoulder rest (1), a swing height adjustment means (4), an hand rest (11), a vertical support (13), a height adjustment means (14), and an all terrain foot (18). The shoulder rest (1), preferably consisting of ¾ inch aluminum pipe (2), or other suitable light weight rigid material, being encased in foam padding (3), or other suitable cushioning material, having a reversely bent underarm portion running from in front of the underarm, in a semi-circular manner, so that it rises above the underarm at the rear and then extends rearward a sufficient distance, preferably 9 inches, to accommodate the free swing of the user's elbows and then makes a reverse bend to vertical, and adjustably communicates with the hand rest (11) by a swing height adjustment means (4).

As shown in FIG. 2, the swing height adjustment means (4) is comprised of a swing height adjustment rod (5), being of rigid construction and having an outside diameter slightly less than the inside diameter of the ¾ inch aluminum pipe (2) of the shoulder rest, so that it slidably fits within the ¾ inch aluminum pipe (2) and has adjustment holes (6) through its diameter regularly spaced at one inch intervals along its length, aligned so as to communicate with the 5/16ths diameter bolt with self locking nut (7) on the reinforcement collar (8) which is fixedly attached by usual means to the end of the shoulder rest (1), the end of the swing height adjustment rod (4) opposite to the end slidably inserted into the shoulder rest (1) through the reinforcement collar (8) being fixedly mounted to the inside of the contiguous end of the ¾ inch aluminum pipe (10) of the hand rest (11). The vertical distance between the shoulder rest (1) and the hand rest (11) being variable by changing the point of engagement of the 5/16th diameter bolt with self-locking nut (7) in the adjustment holes (6) along the length of the swing height adjustment rod (5).

With further reference to FIG. 1, the hand rest (11), comprised of ¾ inch aluminum pipe (10), or other suitable material, covered with foam padding (9), runs vertically from the swing height adjustment means (4) and reverse bends from the vertical to parallel the run of the shoulder rest (1) and extends a like distance and is provided with a semi-circular portion near its end to accommodate the user's hand. The hand rest (11) communicates fixedly by normal means, such as welding or bonding, with the vertical support (13), made of the same suitably rigid and hollow material as the shoulder rest (1) and the hand rest (11), such as ¾th inch aluminum pipe, which extends downward a sufficient distance, so that the user, when resting on the underarm portion of the shoulder rest (1), has their lower extremities fully extended. This vertical support (13) is also provided with a height adjustment means (14) at its lower end which then rotatably attaches to an all terrain foot (18).

With reference to FIGS. 1, 3, 4, 5 & 6, the height adjustment means (14) is shown to be comprised of an height adjustment rod (15), of suitable rigid material and having an exterior diameter slightly smaller than the inside diameter of the vertical support (13), so that it can slide up and down within said vertical support (13), and provided with holes (16) regularly spaced along its length so as to communicate with a 5/16th diameter spring pin (17) set into the base of the vertical support (13), so that the overall length of the vertical support (13) may be adjusted by engaging the 5/16th diameter spring pin (17) in various of the holes (16). The bottom end of the height adjustment rod (15) expands in diameter to larger than the outside diameter of the vertical support (13) and forms an height adjustment rod flange attachment fork (28), which two tongs extend the length of the attachment flange (23) and are spaced sufficiently apart to accommodate the thickness of the attachment flange (23), and has a bolt or channel pin (19), equipped with a spacer collar (21) and retention nut (20), shown in FIG. 7, extending perpendicularly through the tongs of the height adjustment rod flange attachment fork (28) and through the hole in the attachment flange (29) of the all terrain foot (18) so that it is rotatable fore and aft in relation to the user of the Swing-Free Crutch, provided that the location of the hole in the attachment flange(29) is so located so that, when the bolt(19) is installed, the top face of the attachment flange(25) physically impinges on the crotch(31) of the height adjustment rod flange attachment fork(28) so that rotation of the attachment flange around the bolt (19) is limited from 0 to 15 degrees.

With specific reference to FIGS. 4, 5, & 6, the all terrain foot (18) is shown being comprised of a foot vertical support (22) and elliptical shaped inner foot (24), made of suitable flat rigid material such as aluminum, having an attachment flange (23) at its top of tapering width and provided with a hole in the attachment flange (29) to accommodate the bolt or channel pin (19), and being attached at the base of its foot vertical support (22) to an inner foot (24), of suitably rigid material, by standard weld means(26) and oriented at 15 degrees from perpendicular to the inner foot(24) toward the user, so that the swing-free crutch is comprised of a right and left. A removable shoe print (27), made of suitable material such as rubber or leather, is attached to beneath the inner foot (24) by means of slots (30) molded into the top of the shoe print (27) being of sufficient dimension to removably accommodate the inner foot (24) and having a suitable non-skid tread on its bottom face.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A crutch wherein a vertical support between a shoulder rest and a hand rest is displaced rearward, being comprised of a shoulder rest means, a swing height adjustment means, a hand rest means, a vertical support means, a height adjustment means and an all terrain foot means wherein:

said shoulder rest means is comprised of rigid hollow pipe which extends in a semi-circular manner, extending rearward, then makes a reverse bend to vertical adjustably communicating with a swing height adjustment means;

said swing height adjustment means being comprised of a swing height adjustment rod of suitable rigid material having an outside diameter slightly less than an inside diameter of the rigid hollow pipe of the shoulder rest so that it slidably fits therein and having regularly spaced holes through it at one inch intervals along its length aligned so as to accommodate a bolt secured by a self locking nut which extends from a reinforcement collar of suitably rigid material which is fixedly attached to an end of the shoulder rest by standard weld or bonding means and an end of the swing height adjustment rod opposite to an end extending into the shoulder rest is rigidly fixed into an end of a hand rest means by standard weld or bonding means so that vertical distance between the shoulder rest and hand rest is adjustable by engaging the bolt in different holes along the length of the swing height adjustment rod;

said hand rest means is comprised of rigid hollow pipe which extends vertically from the swing height adjustment then makes a reverse bend to parallel the shoulder rest a like distance, having within and near its end a semi-circular portion, and is joined by standard weld or bonding means to a vertical support means at its top;

said vertical support means being comprised of rigid hollow pipe which extends vertically, and includes a height adjustment means at its lower end;

said height adjustment means being comprised of a height adjustment rod of suitable rigid material having an outside diameter slightly less than the inside diameter of the pipe of the vertical support so that it slidably fits therein and having regularly spaced holes through it at one inch intervals along its length aligned so as to accommodate a spring pin set by standard means near the lower end of the vertical support so that the vertical support may be adjusted and said height adjustment rod, at its lower end, expands in diameter to larger than the outside diameter of the vertical support and forms a height adjustment rod flange attachment fork having two tongs, extending downward a sufficient length and spaced sufficiently apart so as to accommodate an attachment flange of an all terrain foot means, and having a bolt or channel pin, equipped with a spacer collar, and held in place by a standard retention nut means, extending perpendicularly through the tongs of the height adjustment rod flange attachment fork and through a hole in an attachment flange of an all terrain foot means, said hole being located on an attachment flange so that, when the bolt is installed, a top face of the attachment flange physically impinges on a crotch of the height adjustment rod flange attachment fork so that rotation of the attachment flange around the bolt is limited from 0 to 15 degrees;

said all terrain foot means, being made of suitable flat rigid material, is comprised of a foot vertical support, extending from the top of an elliptically shaped inner foot vertically and having an attachment flange at its top end and being attached by standard weld means to the top of the inner foot at 15 degrees from perpendicular toward the user at a point so that the foot vertical support is positioned in a center of the elliptically shaped inner foot of the crutch, so that there is a right hand and a left hand crutch, and a shoe print means made of suitable material such as rubber or leather, being slightly larger in diameter than the elliptically shaped inner foot, equipped with slots molded into and around the top edge of the shoe print to removably accommodate the thickness of the elliptically shaped inner foot and having a suitable non-skid tread on its bottom face.

* * * * *